United States Patent [19]

Hashizume

[11] Patent Number: 4,972,822

[45] **Date of Patent: * Nov. 27, 1990**

[54] IGNITION APPARATUS FOR AN INTERNAL COMBUSTION ENGINE

[75] Inventor: Atsushi Hashizume, Hyogo, Japan

[73] Assignee: Mitsubishi Denki Kabushiki Kaisha, Tokyo, Japan

[ * ] Notice: The portion of the term of this patent subsequent to Aug. 22, 2006 has been disclaimed.

[21] Appl. No.: 338,007

[22] Filed: Apr. 14, 1989

[30] Foreign Application Priority Data

Apr. 14, 1988 [JP] Japan ..... 63-93929

[51] Int. Cl.[5] ..... F02P 11/00; F02P 3/00

[52] U.S. Cl. ..... 123/631; 123/652

[58] Field of Search ..... 123/179 BG, 603, 631, 123/652, 149 C, 651

[56] References Cited

U.S. PATENT DOCUMENTS 4,679,540 7/1987 Abe et al. ..... 123/603 X
4,709,684 12/1987 Kaiser et al. ..... 123/652 X
4,858,587 8/1989 Hashizume ..... 123/631

*Primary Examiner*—Tony M. Argenbright
*Attorney, Agent, or Firm*—Sughrue, Mion, Zinn, Macpeak and Seas

[57] ABSTRACT

Disclosed is an ignition apparatus for an internal combustion engine adapted to be started by the rotation of a crank shaft upon rotation of a starter. A sensor detects first and second different angular positions of the crank shaft to change the output level at the respective angular positions. In response to the output of the sensor, the ignition coil is energized and then de-energized. When a voltage generated by the starter is detected upon the reverse rotation of the rotary member, the state of the ignition coil is maintained unchanged.

18 Claims, 8 Drawing Sheets

IGNITION APPARATUS FOR AN INTERNAL COMBUSTION ENGINE

BACKGROUND OF THE INVENTION:

1. Field of the Invention

This invention relates to an ignition apparatus for an internal combustion engine capable of preventing generation of ignition sparks during the reverse rotation of a crank shaft of the engine.

2. Description of the Prior Art

When starting an internal combustion engine, a starter is generally energized through an ignition switch to rotate a rotary member, such as a crank shaft, while ignition sparks are generated by an ignition plug once for every rotation thereof to cause the mixed gas to explode and thus to initiate and continue the engine rotation. In order to generate ignition sparks from the ignition plug, a conventional ignition apparatus is provided with a sensor operable in synchronization with the crank shaft of the engine for detecting its specific angular positions and with a microcomputer receiving the output of the sensor. The signal output from the microcomputer is supplied to a transistor to the output end of which an ignition coil is connected, so that when the sensor has detected a specific angular position of the engine crank shaft a signal is generated from the microcomputer to turn off the transistor, thereby causing an instantaneous flow of high current through the ignition coil to generate an ignition spark at the ignition plug.

FIG. 1 is a circuit diagram illustrating an example of a conventional ignition apparatus. In this figure, a sensor 1 is provided in association with an internal combustion engine EN for the purpose of detecting the angular postions of a crank shaft CS thereof. The output of the sensor 1 is connected to an input port 21 of a microcomputer 2 which is, in turn, connected at its output port 22 to the base electrode of a transistor 3. The emitter electrode of the transistor 3 is grounded and the collector electrode thereof is connected to one end of the primary winding of an ignition coil 4. The other end of the primary winding of the coil 4 is connected to the positive end of a battery 5, the negative end of which is grounded. On the other hand, the output end of the secondary winding of the coil 4 is grounded through an ignition plug 6.

A practical example of the sensor 1 is shown in FIG. 2. A projection 12 is formed on an outer peripheral portion of a rotor 11 which is connected to the engine crank shaft CS for rotation therewith in the direction shown by an arrow X. The projection 12 extends between first and second angular positions $\theta_1$ and $\theta_2$ of the crank shaft CS. Located adjacent to the outer periphery of the rotor 11 is a proximity switch 13 which generates between its output terminal 14 and a ground terminal 15 a high level output during the period when the projection 12 is opposed to the switch and also a low level output during the remaining period. Thus, as the rotor 11 rotates in the direction shown by the arrow X the output level of the output terminal 14 is turned from a low level to a high level (first state) at the first angular position $\theta_1$, as shown in FIG. 3, and returns from the high level to the low level (second state) at the second angular position $\theta_2$.

FIG. 4 illustrates waveforms of the output voltage a of the sensor 1, the output voltage b of the microcomputer 2, the collector voltage c of the transistor 3 and the secondary output voltage d of the ignition coil 4. The operation of the ignition apparatus of FIG. 1 will be described below with reference to the illustration in FIG. 4. It is assumed that the ignition switch has been turned ON to drive the starter and the crank shaft CS and thus that the rotor 11 has been rotated in the direction shown by the arrow X in FIG. 2, such a rotation of the rotor 11 being hereafter referred to as the forward rotation and the rotation thereof in the direction opposite to the arrow X being referred to as the reverse rotation. In FIG. 4 rotor 11 is assumed to make the forward rotation during the period up to the time $t_8$ and the reverse rotation after that time. At time $t_1$, when the sensor 1 detects the first angular position $\theta_1$ of the rotor 11, the logic level of the input port 21 of the microcomputer 2 turns from low to high to cause the microcomputer 2 to compute the time that has elapsed from the preceding rise of the level of the input port 21, thereby allowing a predicted ignition time $t_2$ to be calculated by the microcomputer 2. As a result, the output port 22 of the microcomputer 2 turns to the low level at the time $t_2$ after the lapse of a predetermined time from the time $t_1$, and the transistor 3 turns OFF to cut off the current flowing through the primary winding of the ignition coil 4, thereby generating an ignition spark at the ignition plug 5. At time $t_3$, when the sensor 1 detects the second angular position $\theta_2$, the input port 21 of the microcomputer 2 turns to low level and the microcomputer 2 calculates a predicted time $t_4$ for initiating the flow of current through the ignition coil 6 based on the calculation of the time that has elapsed from the preceding rise of the level of the input port 21 to the time $t_1$. Thus, the output port 22 of the microcomputer 2 turns to the high level at the time $t_4$ after the lapse of a predetermined time from the time $t_3$ and the transistor 3 turns ON to cause the current to flow through the primary winding of the ignition coil 6. At a time $t_5$, when the sensor 1 detects the first angular position $\theta_1$, the level of the input port 21 of the microcomputer 2 again turns from low to high, allowing the time period from the time $t_1$ to the time $t_5$ to be calculated, thereby determining a subsequent predicted ignition time $t_6$ with the aid of the microcomputer 2. Thus, at a time $t_6$ after the lapse of a predetermined time from the time $t_5$, the output port 22 of the microcomputer 2 falls to the low level and the transistor 3 turns OFF to cut off the current flowing through the primary winding of the ignition coil 4, thereby generating an ignition spark on the ignition plug 5. Assuming that, after the sensor 1 has detected the second angular position $\theta_2$ at a time $t_7$, the engine starts to reversely rotate at a time $t_8$, the sensor 1 detects the second angular position $\theta_2$ at a time $t_{10}$, the output thereof is turned from high to low, the first angular position $\theta_1$ is detected at a time $t_{12}$ and the output of the sensor 1 again turns from high to low. The microcomputer 2 predicts the time at which the level of the output port 22 changes in response to the change in level of the input signal of the input port 21, so that at a time $t_9$ after the lapse of a predetermined time from the time $t_7$, the output port 22 is turned to the high level to turn ON the transistor 3 and causes the current to flow through the primary winding of the ignition coil 4. A predicted ignition time $t_{11}$ is determined as a result of the computed time period from the time $t_5$ to the time $t_{10}$ in response to the change in level of the input port 21 from low to high at the time $t_{10}$. At the time $t_{11}$ after the lapse of a predetermined time from the time $t_{10}$, the output port 22 then falls to the low level to turn OFF the transistor 3 and cut off the primary current of the ignition coil 4. Consequently, an ignition spark will be generated at the ignition plug 5 at a wrong or incorrect ignition position.

As described above, the conventional ignition apparatus encounters problems in that generation of an ignition spark at wrong or incorrect time may occur during the reverse rotation of the engine such as to cause damage.

SUMMARY OF THE INVENTION

The present invention has been accomplished in order to solve the above-mentioned problems and an object thereof is to provide an ignition apparatus for an internal combustion engine in which no ignition spark is generated at the ignition plug during the reverse rotation of the crank shaft.

In order to attain the above object, the ignition apparatus in accordance with one aspect of the present invention comprises:

angle detecting means for detecting two different angular positions of a rotary member of an internal combustion engine to allow the output level at the respective angular positions detected to be changed;

ignition control means for intermittently interrupting the flow of current through an ignition coil in response to the output of the angle detecting means so as to allow ignition sparks to be generated at an ignition plug at a predetermined interval of time;

signal detecting means connected to a starter for detecting a signal generated by the starter upon the reverse rotation of the rotary member; and ignition obstructing means for controlling the ignition control means in response to the signal detecting means so as not to change the state of the ignition coil, thereby preventing any ignition spark from being generated at the ignition plug.

The angle detecting means may be provided with a sensor for outputting signals changing between first and second levels at first and second angular positions of the rotary member of the engine.

The ignition control means may include a transistor connected in series to the ignition coil and a microcomputer for determining the times when the transistor turns ON and OFF in response to the outputs of the first and second levels from the sensor.

The signal detecting means includes:

voltage producing means connected to the starter for producing a voltage corresponding to that generated in the starter;

means for generating a reference voltage;

means for comparing the outputs of the voltage producing means and reference voltage generating means to generate a third level output upon the forward rotation of the engine and a fourth level output upon the reverse rotation thereof;

the output of the comparing means being supplied to the microcomputer so that the microcomputer does not operate to change the state of the transistor after the output of the fourth level signal from the comparing means, whereby the microcomputer acts as an ignition obstructing means.

In one embodiment, the voltage producing means includes two resistors connected in series to each other and connected between a positive terminal of a power source and a non-grounded terminal of the starter, the voltage generated in the starter being taken out of the intermediate junction between the resistors; the reference voltage generating means including two resistors connected in series to each other and connected in parallel to the power source; the reference voltage being taken out of the intermediate junction between the resistors; and the comparing means being a comparator to which the voltages from these junctions are input.

In another embodiment, the voltage producing means includes two resistors connected in series to each other and connected between a positive terminal of a power source and a non-grounded terminal of the starter, the voltage generated in the starter being taken out of the intermediate junction between the resistors; the comparing means being an inverter; the reference voltage being the inverted threshold voltage of the inverter; and the fourth level output from the inverter being generated when the voltage from the intermediate junction exceeds the inverted threshold voltage.

In a further embodiment, the voltage producing means includes two resistors connected in series to each other and connected between a positive terminal of a power source and a non-grounded terminal of the starter, the voltage generated in the starter being taken out of the intermediate junction between the resistors; the comparing means being a second transistor; the reference voltage being the voltage between the base and emitter electrodes thereof; and the fourth level output from the second transistor being generated when the voltage from the intermediate junction exceeds the voltage between the base and the emitter electrodes of the second transistor.

The ignition apparatus of the present invention according to another aspect thereof comprises:

sensor means for detecting first and second angular positions of a rotary member of an internal combustion engine to allow the output between first and second levels to change every time each of the angular positions is detected;

ignition time calculating means connected to the sensor means for calculating a first time at which a current starts to flow through the ignition coil and a second time at which the current is cut off, in response to the outputs of the first and second levels;

ignition control means connected to the ignition time calculating means and operable to cause current to flow through the ignition coil at the first time and to cut off such current at the second time;

signal generating means connected to the starter for generating a signal representing the reverse rotation of the rotary member when it occurs;

comparing means for comparing the level of the signal from the signal generating means with a reference level to allow the output level to change when the signal level changes by a predetermined value relative to the reference level; and ignition obstructing means operable to supply a signal to the ignition control means in response to a change in the output level of the comparing means to allow the ignition control means so as to operate not to change the state of the ignition coil.

The ignition time calculating means may be a microcomputer. The output of the sensor means is supplied to a first input port of the microcomputer which receives the output of the comparing means at its second input port and also acts as the ignition obstructing means.

The reference level may be a reference voltage generated by a voltage divider connected in parallel to the power source, and the comparing means can be a comparator for comparing the levels of the signal from the signal generating means with the reference voltage from the voltage divider.

The comparing means may be an inverter and in this case the reference level is an inverted threshold voltage of the inverter. The comparing means may alternatively be a transistor and in this case the reference level is a voltage between the base and emitter electrodes thereof.

According to a further aspect of the invention, an ignition apparatus for an internal combustion engine which is started by rotating its rotary member with a starter comprises an ignition coil having primary and secondary windings, a transistor connected in series to the primary winding and an ignition plug connected in series to the secondary winding for generating an ignition spark every time the current flowing through the primary winding of the ignition coil is cut off.

Detecting means detects a first angular position of the rotary member and a second angular position thereof different from the first, and generates the output which changes from a first level to a second level, or vice versa, every time the first and second angular positions are detected.

Located between the detecting means and the transistor is ignition control means which calculates the time at which the transistor turns ON to cause the current to flow through the primary winding of the ignition coil and the time at which the transistor turns OFF to cut off such current, in response to the first and second signal levels from the detecting means, thereby operating to allow the transistor to be turned ON and OFF to generate ignition sparks at the ignition plug accordingly.

Signal generating means is connected to the starter to detect a voltage generated by the starter and generates a first voltage during the forward rotation of the rotary member and a second voltage during the reverse rotation thereof. In response to the second voltage signal from the signal generating means, ignition obstructing means sends to the ignition control means a command to prevent the state of the transistor from being changed after the generation of the second voltage signal, thereby preventing the generation of any ignition spark at the ignition plug.

The ignition control means can be a microcomputer which receives the signal from the detecting means at its first input port and also the signal from the signal generating means at its second input port so as to act as the ignition obstructing means.

The signal detecting means may be a comparing means for comparing the level of voltage generated from the starter with the reference level.

The reference level can be generated by a voltage divider connected in parallel to the power source, and the comparing means is a comparator for comparing the level of a voltage corresponding to the voltage generated in the starter with the level of the reference voltage from the voltage divider.

The comparing means may be an inverter and the reference level can be the inverted threshold voltage thereof. The comparing means may also be a transistor and the reference level can be the voltage between the base and emitter electrodes thereof.

According to a still further aspect, the invention provides an internal combustion engine including an ignition plug, an ignition coil through which the flow of current is intermittently interrupted at a predetermined interval for generating ignition sparks at the ignition plug, the engine being started by rotating a rotary member with a starter, comprising:

sensor means for detecting two different angular positions for every rotation of the rotary member during the starting period of the engine, the level of the signal output from the sensor means being charged upon the detection of each of the angular positions;

ignition control means for causing the current to flow through the ignition coil at a first time and to be cut off at a second time, in response to changes in the output level of the sensor means, thereby generating an ignition spark at the ignition plug at a predetermined time;

signal generating means connected to the starter for generating a signal when the voltage generated in the starter exceeds a predetermined level upon the reverse rotation of the rotary member; and ignition obstructing means for operating the ignition control means so that when the signal is output from the signal generating means no ignition spark is generated at the ignition plug.

Other objects and benefits of the invention will become apparent from the following detailed description which is to be read with reference to the accompanying drawings.

DESCRIPTION OF THE PREFERRED EMBODIMENT

Figure 1:
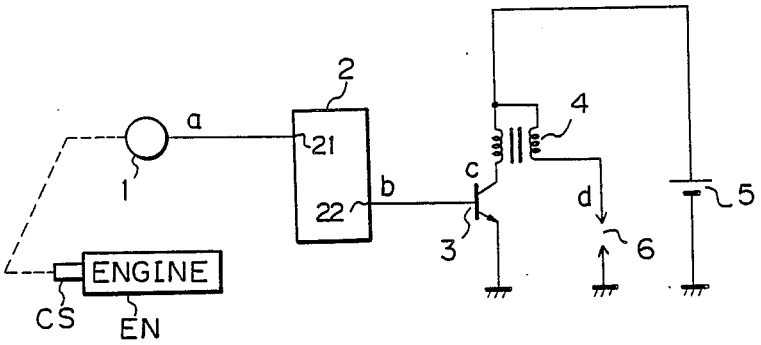
Fig. 1 ( PRIOR ART )
FIG. 1 is a circuit diagram showing the arrangement of a conventional ignition apparatus.
Figure 2:
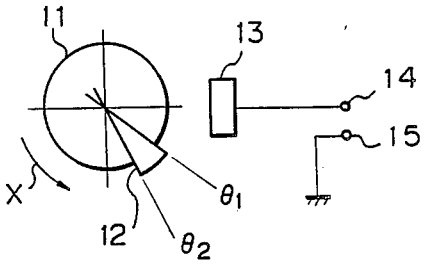
Fig. 2 ( PRIOR ART )
FIG. 2 shows a practical example of the sensor of FIG. 1.
Figure 3:
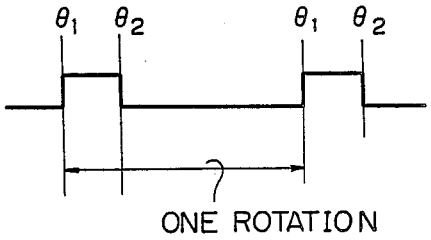
Fig. 3 ( PRIOR ART )
FIG. 3 shows a waveform of the output from the sensor of FIG. 2.
Figure 4:
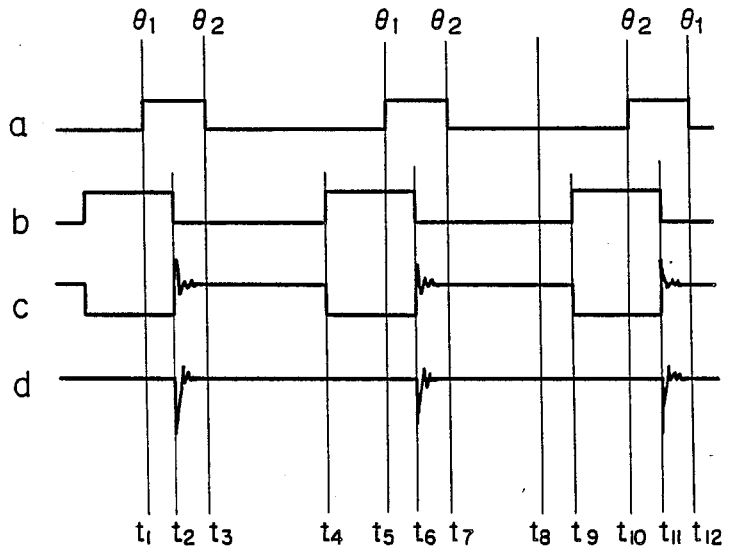
Fig. 4 (PRIOR ART)
FIG. 4 shows waveforms of the output voltages at portions of the apparatus of FIG. 1.
Figure 5:
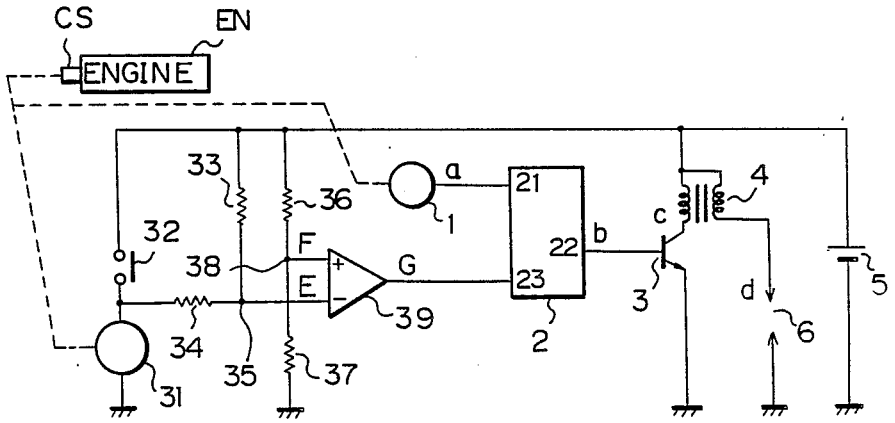
FIG. 5 is a circuit diagram showing an embodiment of the ignition apparatus in accordance with the present invention.

FIG. 5 is a circuit diagram of an embodiment of the ignition apparatus for an internal combustion engine in accordance with the present invention. In this drawing, elements similar to those of the apparatus of FIG. 1 are referred to by the same reference signs and numerals, and further description of such elements is omitted.

Referring to FIG. 5, a starter 31 for starting the internal combustion engine EN is connected at one end through a switch 32 to the positive end of the battery 5. The other end of the starter 31 is grounded. When the switch 32 is turned ON, the starter 31 is driven to start the engine EN. Resistors 33, 34 are connected in series to each other and in parallel to the switch 32. Connected in series between the positive end of the battery 5 and the ground are resistors 36, 37 which constitute a voltage divider. A junction 35 between the resistors 33 and 34 is connected to the inverted input terminal of a comparator 39 and a junction 38 between the resistors 36 and 37 is connected to the non-inverted input terminal thereof. The output terminal of the comparator 39 is connected to the second input port 23 of the microcomputer 2.

Figure 6:
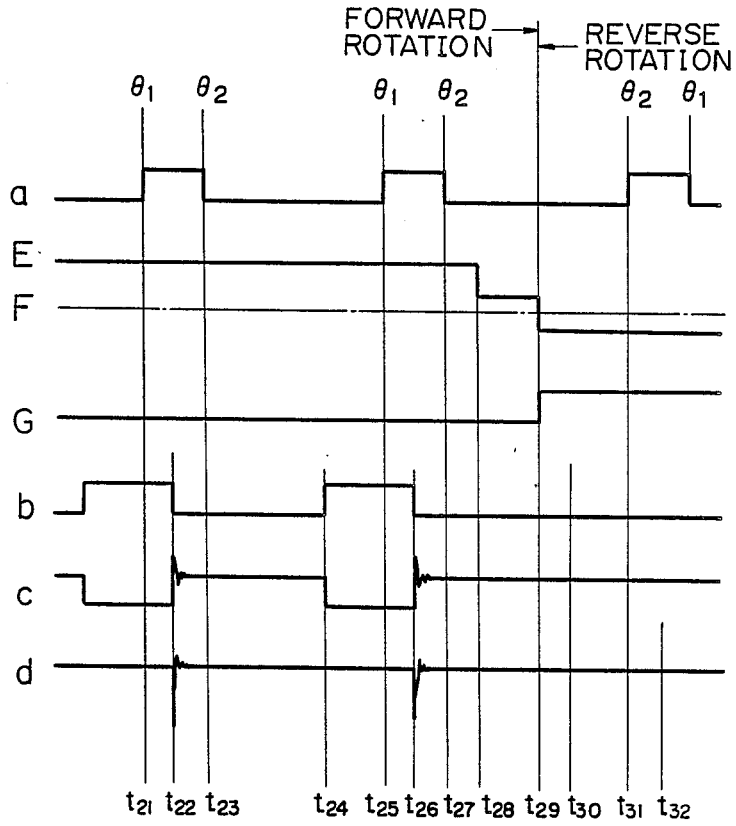
FIG. 6 shows waveforms of the output voltages at portions of the apparatus of FIG. 5 in the case wherein the crank shaft of the engine makes the forward rotation until the reverse rotation occurs.

FIG. 6 shows voltage waveforms at portions of the ignition apparatus of FIG. 5, i.e., waveforms of the output voltage a of the sensor 1, the output voltage b of the microcomputer 2, the collector voltage c of the transistor 3, the secondary output voltage d of the ignition coil 4, the voltage E at the junction 35, the voltage F at the junction 38 and the output voltage G of the comparator 39, in relation to the lapse of time. The operation of the apparatus of FIG. 5 will be described below by reference to FIG. 6.

When the input port 21 of the microcomputer 2 turns from low to high at a time $t_{21}$, the microcomputer 2 computes the period of time from the preceding rise time of the input port 21 to the time $t_{21}$ to determine a predicted ignition time $t_{22}$ based on the result of the computation. Thus, an ignition spark is generated at the ignition plug at a time $t_{22}$ after a predetermined time has elapsed from the time $t_{21}$. When the sensor 1 detects the second angular position $\theta_2$ of the crank shaft, the input port 21 turns to low at a time $t_{23}$ and, at an energization initiating time $t_{24}$ predicted based on the above-mentioned computed time, the transistor 3 is turned ON to cause the current to flow through the primary winding of the ignition coil 4. When the input port 21 of the microcomputer 2 again turns to the high level at a time $t_{25}$, the length of the period from $t_{21}$ to $t_{25}$ is computed by the microcomputer 2 to determine a predicted ignition time $t_{26}$. Thus, an ignition spark is generated at the ignition plug 5 at the time $t_{26}$ after a predetermined time was elapsed from the time $t_{25}$. If the switch 32 remains closed till a time $t_{26}$, the voltage E at the junction 35 is higher than the voltage F at the junction 38 till this time is reached so that the output of the comparator 39 is held at the low level.

Assume that, even after the time $t_{28}$, the crank shaft CS continues to rotate forward and then starts to reversely rotate at a time $t_{29}$, that the switch 32 is opened during the period from the time $t_{28}$ to the time $t_{29}$, and that the voltage E at the junction 35 is held higher than the voltage F at the junction 38 by appropriately selecting the values of the resistors 33, 34, 36 and 37. Thus, the output G of the comparator 39 is held at the low level till the time $t_{29}$. If the crank shaft begins to reversely rotate at the time $t_{29}$, the rotor of the starter 31 will be rotated in the direction opposite to the forward rotation so that a negative voltage is generated at the terminal of the starter 31 in accordance with the principle of a generator. By appropriately selecting the values of the resistors 33, 34, 36, 37, the voltage E at the junction 35 is changed to a value lower than that of the voltage F at the junction 38, when the negative voltage is generated by the starter 31. Accordingly, the output of the comparator 39 is inverted to the high level and thus the second input port 23 of the microcomputer 2 is turned to the high level. The microcomputer 2 is so programmed that the signal level of the output of the output port 22 remains unchanged when the second input port 23 is at the high level. Even at a time $t_{30}$ at which the transistor 3 is to be turned ON to start energizing the ignition coil 4, the output port 22 of the microcomputer 2 is held at the low level, as shown by the waveform b in FIG. 6, so that no current flows through the primary winding of the ignition coil 4. Also, thereafter, the output port 22 is held at the low level, and even when the sensor detects the second angular position $\theta_2$ at a time $t_{31}$ and supplies the high level output to the input port 21 of the microcomputer 2, no change in the output level of the output port 22 of the microcomputer 2 occurs at a time $t_{32}$ which follows the time $t_{31}$ by a predetermined time. Accordingly, the generation of an ignition spark at the ignition plug 6 is completely prevented after the reverse rotation of the crank shaft CS has been detected.

Figure 8:
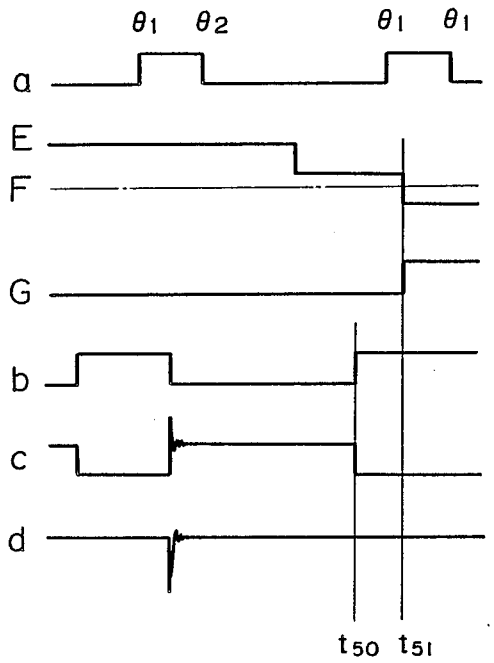
FIGS. 7 and 8 are waveform diagrams showing the operation of the apparatus of FIG. 5 wherein the crank shaft of the engine begins to reversely rotate at different times.
Figure 7:
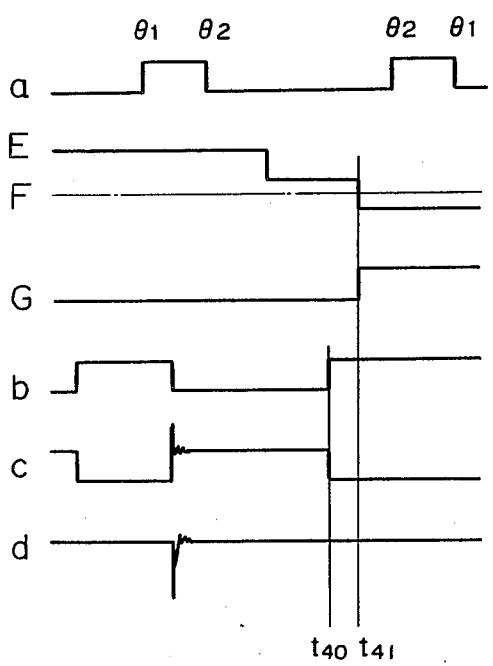

Since the microcomputer 2 is so programmed that, as described above, the signal level of the output port 22 remains as it is when the second input port 23 turns to the high level, if the crank shaft CS is reversely rotated when the output port 22 is at the high level, the microcomputer 2 maintains the output port 22 at the high level. FIG. 7 shows a case in which the reverse rotation of the crank shaft CS is detected at a time $t_{41}$ between the time when the microcomputer 2 turns the output port 22 to the high level at a time $t_{40}$ and the time when the sensor 1 detects the second angular position $\theta_2$. FIG. 8 also shows a case in which the reverse rotation of the crank shaft CS is detected at a time $t_{51}$ following a time $t_{50}$ when the microcomputer 2 turns the output port 22 to the high level and between the time when the sensor 1 detects the first angular position $\theta_1$ and the time when the second angular position $\theta_2$ is detected. In either case, the transistor remains ON after the time $t_{41}$ and $t_{51}$ and no ignition spark is generated.

As described above, from the time of the reverse rotation of the crank shaft CS, the microcomputer 2 operates to maintain the signal level of the output port 22 unchanged, and thus no change is caused in the flow of current through the secondary winding of the ignition coil 4. As a result no ignition spark is generated at the ignition plug 6.

Figure 9:
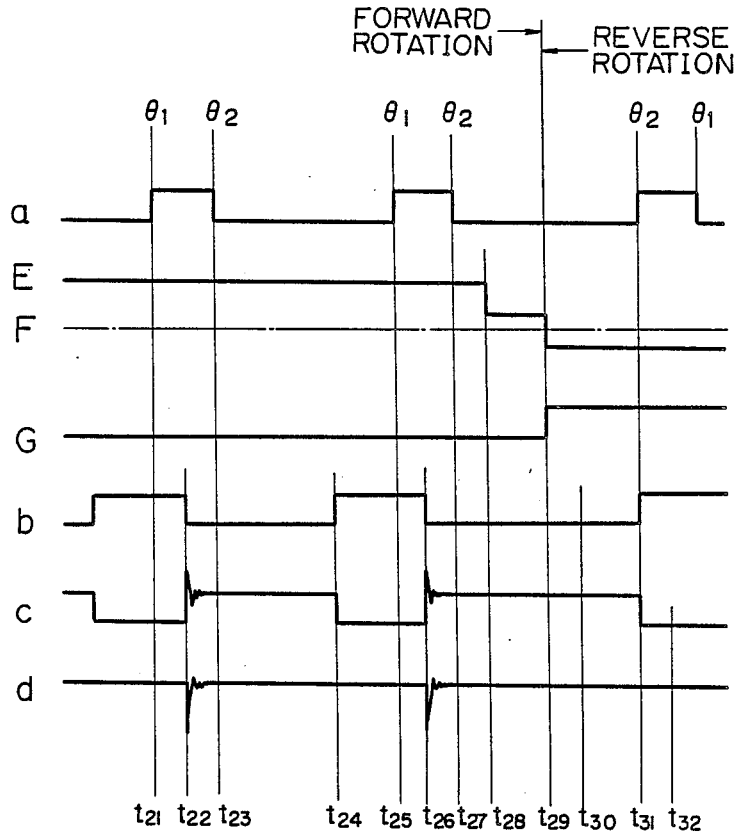
FIGS. 9 to 11 are waveform diagrams showing different modes of operation of the apparatus of FIG. 5, the change of the output level of the microcomputer of FIG. 5 being caused upon detection of the second angular position after the crank shaft has been reversely rotated (FIG. 9), at the time of the reverse rotation of the crank shaft (FIG. 10), and between the time of the reverse rotation of the crank shaft and the time of detecting the second angular position (FIG. 11)

In the event of the crank shaft CS being reversely rotated when the output port 22 of the microcomputer 2 is at the high level, as described above, the microcomputer 2 is adapted to maintain the level of the output port 22 high in order to prevent the ignition spark from being generated. In the event of reverse rotation of the crank shaft CS, however, when the output port of the microcomputer 2 is at the low level, it is not always necessary to maintain the level of the output port 22 low. As shown in FIG. 9, for example, the microcomputer 2 may be programmed so that in the event that the crank shaft CS begins to reversely rotate at a time $t_{29}$ at which the output port 22 of the microcomputer 2 is at the low level and the output level of the comparator switch 22 and thus the signal level of the second input port 23 of the microcomputer 2 are turned to the high level, the microcomputer 2 holds the signal level of the output port 22 unchanged at the time $t_{30}$ at which the ignition coil 4 should be energized. The microcomputer 2 operates to change the level of the output port 22 from low to high at the time $t_{31}$ at which the sensor detects the second angular position $\theta_2$. The input level of the input port 21 of the microcomputer 2 is then turned to and thereafter kept at high level. In such an instance, after the time $t_{31}$, the output port 22 is maintained at the high level and the transistor 3 remains ON to allow the current to continue to flow through the primary winding of the ignition coil 4 so that no ignition spark is generated at the ignition plug 6.

Figure 10:
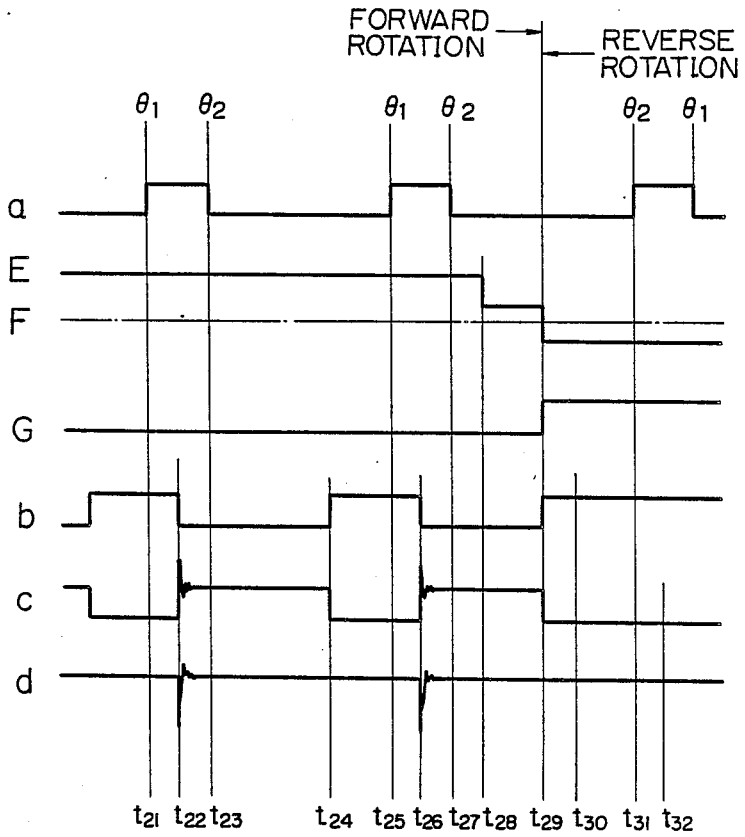
Figure 11:
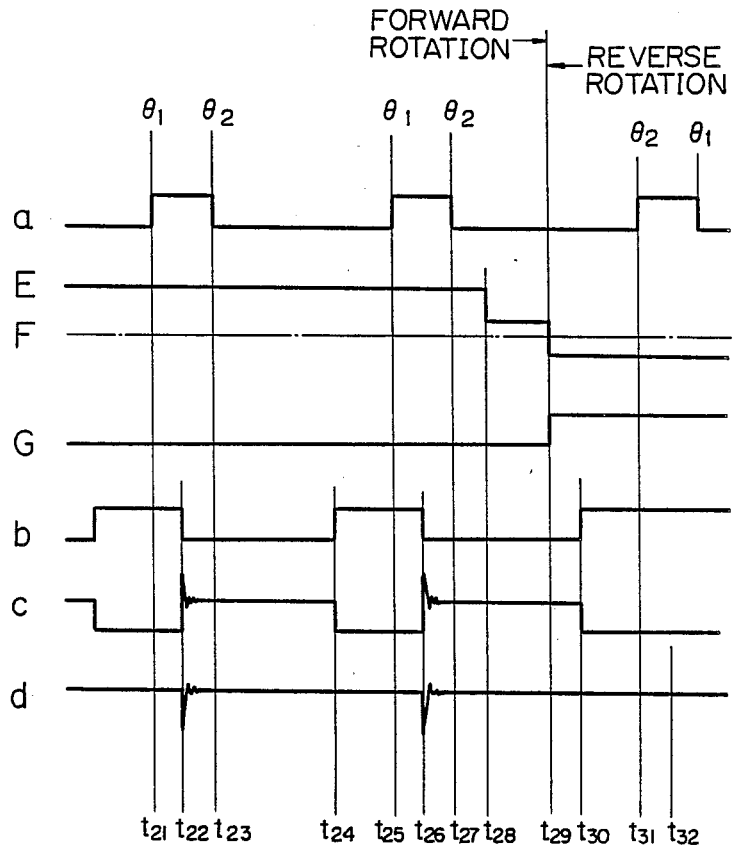

As shown in FIG. 10, the microcomputer 2 may also be programmed so that at the time $t_{29}$ at which the crank shaft CS begins to reversely rotate and the output level of the switching comparator 22 turns from low to high, the output port 22 of the microcomputer 2 is turned to and thereafter maintained at high level. It is, furthermore, possible that, as shown in FIG. 11, after the time $t_{29}$ at which the crank shaft CS begins to reversely rotate the level of the output port 22 of the microcomputer 2 is turned to the high level to turn the transistor 3 ON. Thereafter and when the energization of the ignition coil 4 is initiated at the time $t_{30}$, the transistor 3 is maintained in the ON state. In this instance, the flow of current through the secondary winding of the ignition coil 4 is not cut off and no ignition spark is generated.

Figure 12:
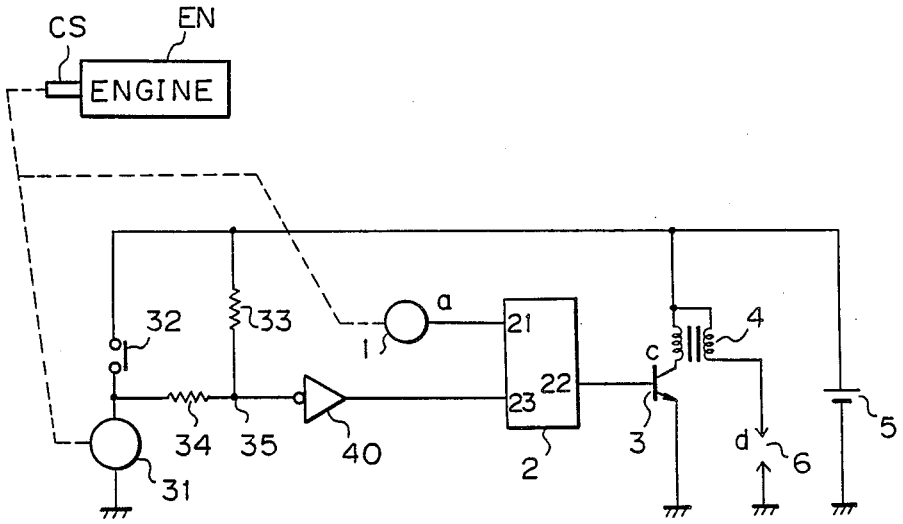
FIG. 12 and 13 show modified examples of the ignition apparatus of the present invention.
Figure 13:
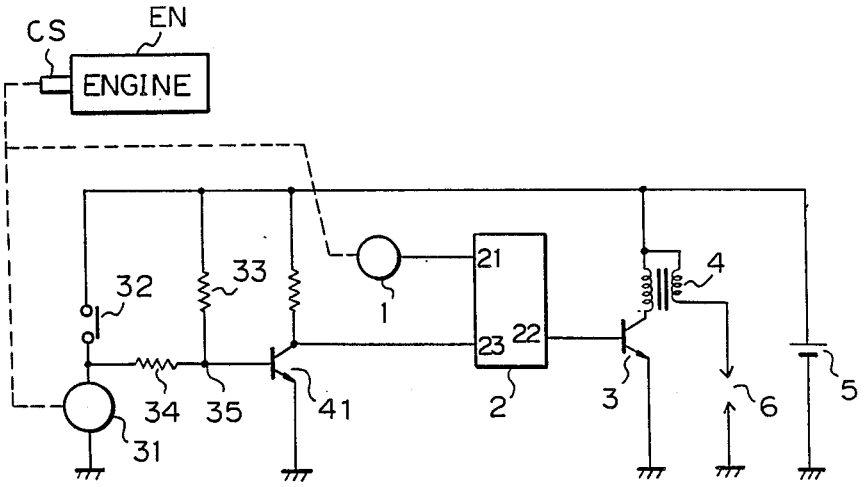

Although the present invention has been described in detail by reference to an embodiment, modifications and variations thereof can of course be made without deviating from the spirit and scope of the invention. For example, in the ignition apparatus of FIG. 5, the negative voltage generated from the starter 31 upon the reverse rotation of the crank shaft CS is compared by the comparator 39 with the reference voltage, but it is possible, as shown in FIG. 12, to use instead the inverted threshold voltage of an inverter 40 which is provided to connect the junction 35 and the second input port 23 of the microcomputer 2. It is also possible, as shown in FIG. 13, to connect the junction 35 to the second input port 23 of the microcomputer 2 through a transistor 41 and use the voltage between the base and emitter electrodes of the transistor 41 as a reference voltage. Furthermore, although the ignition apparatus of FIG. 5 is of a current interruption type, it may be of a CDI type.

What is claimed is:

1. An ignition apparatus for an internal combustion engine started by rotation of a rotary member upon rotation of a starter and including an ignition coil and an ignition plug connected to said ignition coil for generating ignition sparks at a predetermined interval of time, said ignition apparatus comprising:

angle detecting means for detecting two different angular positions of said rotary member of said internal combustion engine to allow the output level at the respective angular positions detected to be changed;

ignition control means for interrupting the flow of current through said ignition coil in response to the output of said angle detecting means to allow ignition sparks to be generated at said ignition plug at said predetermined interval of time;

signal detecting means connected to said starter for detecting a signal generated by said starter upon the reverse rotation of said rotary member; and ignition obstructing means for controlling said ignition control means in response to said signal detecting means so as not to change the state of said ignition coil, whereby no ignition spark is generated at the ignition plug.

2. An ignition apparatus as set forth in claim 1, wherein said angle detecting means includes a sensor for outputting signals changing between first and second levels at first and second angular positions of said rotary member of said engine; and said ignition control means includes a transistor connected in series to said ignition coil and a microcomputer for determining the times when the transistor is turned ON and OFF in response to the outputs of said first and second levels from said sensor.

3. An ignition apparatus as set forth in claim 2, wherein said signal detecting means includes:

voltage producing means connected to said starter for producing a voltage corresponding to that generated in said starter;

means for generating a reference voltage;

means for comparing the outputs of said voltage producing means and said reference voltage generating means to generate a third level output upon the forward rotation of said engine and a fourth level output upon the reverse rotation thereof;

the output of said comparing means being supplied to said microcomputer, so that said microcomputer does not operate to change the state of said transistor after the output of said fourth level signal from said comparing means, whereby said microcomputer acts as said ignition obstructing means.

4. An ignition apparatus as set forth in claim 3, wherein said voltage producing means includes two resistors connected in series to each other and connected between a positive terminal of a power source and non-grounded terminal of said starter, the voltage generated in said starter being taken out of an intermediate junction between the resistors;

wherein said reference voltage generating means includes two resistors connected in series to each other and connected in parallel to the power source, said reference voltage being taken out of an intermediate junction between the resistors; and wherein said comparing means is a comparator to which the voltages from the junctions are input.

5. An ignition apparatus as set forth in claim 3, wherein said voltage producing means includes two resistors connected in series to each other and connected between a positive terminal of a power source and a non-grounded terminal of said starter, the voltage generated in said starter being taken out of an intermediate junction between the resistors;

wherein said comparing means is an inverter, said reference voltage being the inverted threshold voltage of said inverter; and wherein said fourth level output from said inverter is generated when the voltage from said intermediate junction exceeds said inverted threshold voltage.

6. An ignition apparatus as set forth in claim 3, wherein said voltage producing means includes two resistors connected in series to each other and connected between a positive terminal of a power source and non-grounded terminal of said starter, the voltage generated in said starter being taken out of an intermediate junction between the resistors;

wherein said comparing means is a second transistor, said reference voltage being the voltage between the base and emitter electrodes thereof; and wherein said fourth level output from said second transistor is generated when the voltage from said intermediate junction exceeds said voltage between the base and the emitter electrodes of said second transistor.

7. An ignition apparatus for an internal combustion engine started by rotation of a rotary member upon rotation of a starter and including an ignition coil and an ignition plug connected to said ignition coil for generating ignition sparks at a predetermined interval of time, said ignition apparatus comprising:

sensor means for detecting first and second angular positions of said rotary member of said engine to allow the output between first and second levels to be changed every time each of the angular positions is detected;

ignition time calculating means connected to said sensor means for calculating a first time at which a current flows through said ignition coil and a second time at which the current is cut off, in response to the outputs of said first and second levels;

ignition control means connected to said ignition time calculating means and operable to cause the current to flow through said ignition coil at said first time and to cut off such current at said second time;

signal generating means connected to said starter for generating a signal representing the reverse rotation of said rotary member when it occurs;

comparing means for comparing the level of the signal from said signal generating means with a reference level to change the output level when said signal level changes by a predetermined value relative to said reference level; and ignition obstructing means operable to supply a signal to said ignition control means in response to a change in the output level of said comparing means to allow said ignition control means to operate to change the state of said ignition coil.

8. An ignition apparatus as set forth in claim 7, wherein said ignition time calculating means is a microcomputer, the output of said sensor means being supplied to a first input port of said microcomputer, and said microcomputer receives the output of said comparing means at its second input port and also acts as said ignition obstructing means.

9. An ignition apparatus as set forth in claim 8, wherein said reference level is a reference voltage generated by a voltage divider connected in parallel to the power source, and said comparing means is a comparator for comparing the levels of said signal from said signal generating means with the reference voltage from said voltage divider.

10. An ignition apparatus as set forth in claim 8, wherein said comparing means is an inverter and said reference level is the inverted threshold voltage of said inverter.

11. An ignition apparatus as set forth in claim 8, wherein said comparing means is a transistor and said reference level is the voltage between the base and emitter thereof.

12. An ignition apparatus for an internal combustion engine started by rotation of a rotary member by means of a starter, including an ignition coil having primary and secondary windings, a transistor connected in series to said primary winding and an ignition plug connected in series to said secondary winding for generating an ignition spark every time the current flowing through the primary winding of said ignition coil is cut off, said apparatus comprising:

detecting means for detecting a first angular position of said rotary member and a second angular position thereof different from the first angular position and generating an output that changes from a first level to a second level, or vice versa, every time said first and second angular positions are detected;

ignition control means located between said detecting means and said transistor for calculating the time at which said transistor turns ON to cause the current to flow through the primary winding of said ignition coil and the time at which said transistor turns OFF to cut off such current, in response to said first and second signal levels from said detecting means, thereby operating to allow said transistor to turn ON and OFF to generate ignition sparks at said ignition plug;

signal generating means connected to said starter for detecting a voltage generated by said starter and generating a first voltage during the forward rotation of said rotary member and a second voltage during the reverse rotation thereof; and ignition obstructing means responsive to said second voltage signal from said signal generating means to send to said ignition control means a command to prevent the state of said transistor from being changed after the generation of said second voltage signal, thereby preventing the generation of any ignition spark at said ignition plug.

13. An ignition apparatus as set forth in claim 12, wherein said ignition control means is a microcomputer which receives a signal from said detecting means at its first input port and a signal from said signal generating means at its second input port to act as the ignition obstructing means.

14. An ignition apparatus as set forth in claim 13, wherein said signal detecting means is a comparing means for comparing the level of voltage generated by said starter with the reference level.

15. An ignition apparatus as set forth in claim 14, wherein said reference level is a reference voltage generated by a voltage divider connected in parallel to the power source, and said comparing means is a comparator for comparing the level of voltage corresponding to the voltage generated in said starter with the level of the reference voltage from said voltage divider.

16. An ignition apparatus as set forth in claim 14, wherein said comparing means is an inverter and said reference level is the inverted threshold voltage thereof.

17. An ignition apparatus as set forth in claim 14, wherein said comparing means is a transistor and said reference level is the voltage between the base and emitter thereof.

18. An internal combustion engine including an ignition plug, an ignition coil through which the flow of current is interrupted at a predetermined interval for generating ignition sparks at said ignition plug, said engine being started by rotating a rotary member by means of a starter, comprising:

sensor means for detecting two different angular positions for every one rotation of said rotary member during the starting period of said engine, the output signal level of said sensor means being changed upon detection of each of said angular positions;

ignition control means for causing the current to flow through said ignition coil at a first time and to be cut off at a second time, in response to changes in the output level of said sensor means, whereby an ignition spark is generated at said ignition plug at a predetermined time;

signal generating means connected to said starter for generating a signal when the voltage generated in said starter exceeds a predetermined level upon the reverse rotation of said engine; and ignition obstructing means for operating said ignition control means so that when said signal is output from said signal generating means no ignition spark is generated at said ignition plug.

* * * * *